United States Patent [19]

Talmage

[11] 3,978,380

[45] Aug. 31, 1976

[54] RECIPROCATING CORONA PRODUCING APPARATUS

[75] Inventor: Peter Guy Talmage, Lexington, Mass.

[73] Assignee: Coulter Information Systems, Inc., Bedford, Mass.

[22] Filed: Mar. 26, 1975

[21] Appl. No.: 562,219

[52] U.S. Cl. ..... 317/262 A; 250/324; 355/3 R

[51] Int. Cl.[2] ..... G03G 15/02; H01T 19/00

[58] Field of Search..... 317/262 A, 4; 355/3 CH; 250/324, 325, 326

[56] References Cited

UNITED STATES PATENTS

| | | | |
|---|---|---|---|
| 2,965,481 | 12/1960 | Gundlach | 250/325 X |
| 3,743,830 | 7/1973 | Takahashi et al. | 317/262 A X |
| 3,800,153 | 3/1974 | Matsumoto et al. | 317/262 A X |

*Primary Examiner*—R. N. Envall, Jr.
*Attorney, Agent, or Firm*—Silverman & Cass, Ltd.

[57] ABSTRACT

A method for charging an electrophotographic imaging surface includes the steps of reciprocating at least one longitudinally disposed corona electrode along the longitudinal axis and simultaneously applying a corona voltage to the electrode for developing a corona so that a substantially uniform corona charge is applied to the entire electrophotographic imaging surface. An additional step, performed simultaneously with production of the corona and reciprocation of the electrode can be the movement of one of the electrodes or the electrophotographic imaging surface relative to the other. Apparatus employed to perform this method also is disclosed.

14 Claims, 2 Drawing Figures

RECIPROCATING CORONA PRODUCING APPARATUS

BACKGROUND OF THE INVENTION

This invention relates to a method and apparatus for applying a uniform electrical charge to a structure, and more particularly to a method and apparatus for applying a uniform corona produced charge to an electrophotographic member or imaging surface.

It is well known that in electrostatic printing equipment a corona generating device including a corona discharge electrode is employed to place positive or negative charges onto a photoconductive member or surface. The photoconductive member or surface is then exposed to a pattern of light which corresponds to the image to be printed. The pattern of light will discharge the photoconductive surface selectively in accordance with the presence and intensity of the light creating an electrostatic image of the light pattern on the surface. This electrostatic image may be employed in a number of ways now well known in the art in order to reproduce an image on a sheet of paper, or in some instances, the surface or member may be fixed in order to reproduce the electrostatic image.

The nature of photoconductive members is such that it will retain the charge deposited thereon for a very short time period, and only then if maintained in a darkened environment. If it takes some period of time for the charge to be applied to the member the level or intensity of the charge applied at the beginning of the charging process will have delayed or reduced as compared to the charge level applied at the end of the charging process. If the lighted image is exposed after the entire charging process the electrostatic image produced may be nonuniform as a result of this variation in charge level.

The corona generated in the above noted devices could be positively or negatively biased in order to produce either a positive or negative charge depending upon the nature of the photoconductive surface employed. When a positive corona is generated from a metallic filament electrode, the resultant charge applied to the photoconductive surface is generally relatively uniform due to the uniformity of the positive corona electrode emission. Many of the more currently available devices require a negative corona. When a negative corona is generated from a metallic filament electrode, the photoconductive surface obtains a charge which varies in density from point to point due to the nonuniform negative corona electrode emission. It is believed that this nonuniformity in charge is manifest in the developed image since areas containing a higher charge will attract more electrostatic developer material thereto thereby creating a streaked image appearance.

A number of devices have been developed in order to provide a uniform charge on the desired photoconductive surface. One such device employs specially coated electrodes which suppress the widely spaced emission nodes common to negatively biased corona electrode emissions. Another device moves the metallic corona electrode and the surface being charged substantially in orthogonal directions. Still other devices employ alternating currents plus a high voltage direct current to minimize or reduce the nonuniformity. These devices appear to provide a more uniform charge for the above equipment. It should be noted, however, that the above noted equipment generally is rather limited in its photographic reproduction capabilities to reproducing printed matter, because of the nature of the photoconductive surfaces employed.

Electrophotographic members are being developed which are much more sensitive than the members employed in the above-noted equipment. These electrophotographic members are of a quality capable of reproducing or creating high resolution images; that is, each point on the surface of the member is capable of selectively discharging in accordance with the intensity of incident light so that an almost infinite scale of gray can be reproduced in the resultant image. In order to make full use of this feature, the applied corona charge must be substantially uniform across the entire member or surface of the member. This is necessary in order to produce a resultant image which has varying shades that result from variations in the intensity of incident light and not from variations in the initial corona produced charge.

SUMMARY OF THE INVENTION

In practicing this invention a method for charging an electrophotographic member or imaging surface is provided which includes reciprocating at least one longitudinally disposed corona electrode substantially in the longitudinal direction. A corona voltage is applied to the reciprocating electrode in order to develop a corona about the electrode whereby a substantially uniform corona charge will be applied to the entire electrophotographic member or surface. As an additional step the electrode and the electrophotographic member or imaging surface can be moved relative to one another simultaneously with the electrode reciprocation.

An apparatus is also provided which includes a corona producing device having at least one elongate longitudinally disposed corona electrode. A supporting structure mounts the electrode and is adapted to reciprocate in the longitudinal direction. A driver, which in the preferred embodiment takes the form of a motor, is coupled to the support structure and is operative to provide the drive for reciprocating the support structure whereby a substantially uniform corona charge may be applied to the electrophotographic member or surface. In one embodiment a second drive device is coupled to either the support structure or the electrophotographic imaging surface or member for moving one relative to the other during reciprocation of the electrode.

DETAILED DESCRIPTION OF THE PREFERRED EMBODIMENT

Figure 1:
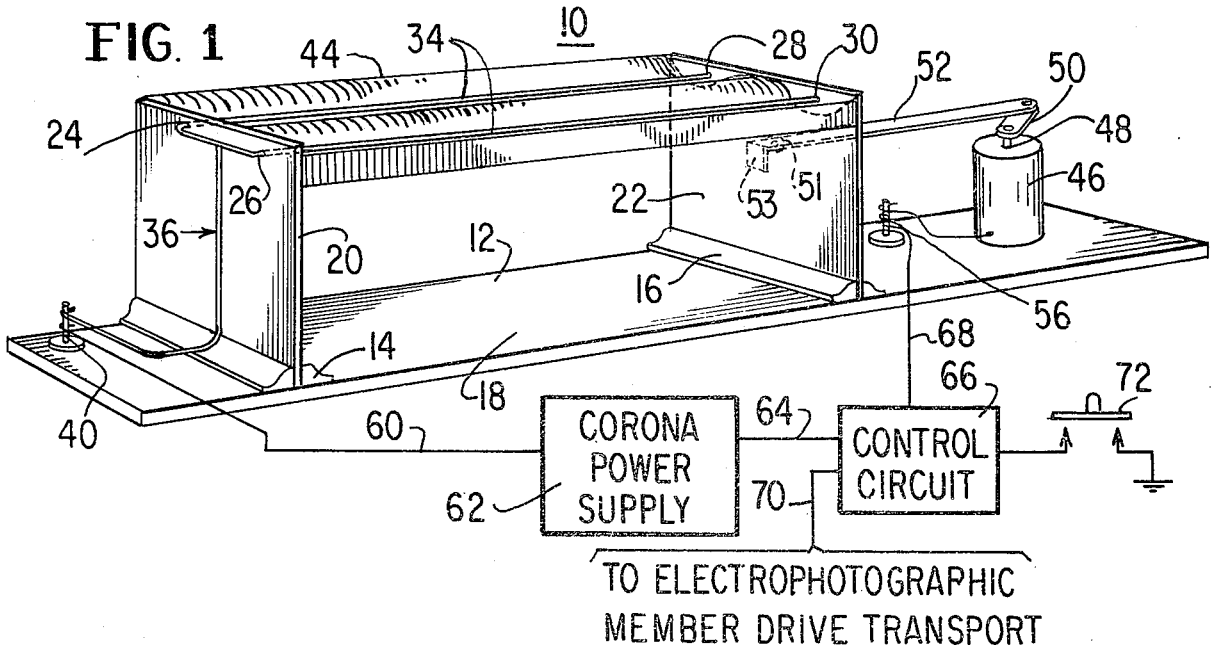
FIG. 1 is a perspective view of the corona discharge apparatus of this invention, and a partial block diagram of the associated electronic equipment.

Referring to FIG. 1, a corona producing device generally identified by the numeral 10 is shown and includes a baseplate 12. Baseplate 12 can be formed from either a conductive or non-conductive material and must have a thickness sufficient to make the plate relatively rigid. Mounting blocks 14 and 16 are secured to one side 18 of baseplate 12. A support arm 20 formed from a sheet of relatively thin flexible material has one end thereof secured in mounting block 14. A second support arm 22 identical to support arm 20 is secured in mounting block 16. Support arms 20 and 22 extend substantially perpendicular to the plane of baseplate 12. Apertures 24 and 26 are formed through support arm 20 adjacent the distal end thereof and apertures 28 and 30 are formed through support arm 22 at substantially the same points as apertures 24 and 26.

Corona producing electrodes 34 extend from aperture 24 to aperture 28 and from aperture 30 to aperture 26. Corona producing electrodes 34 are of the type commonly known in the art which will develop corona about themselves when a high voltage is applied thereto and when they are a proper distance from a ground plane. They are secured in each of the above noted apertures thus effectively providing two elongate corona producing electrodes extending between supporting arms 20 and 22.

Corona producing electrodes 34 are positioned such that they extend substantially parallel to the plane formed by baseplate 12 in a longitudinal direction. If support arms 20 and 22 are formed from an electrically nonconductive material such as, for example, plastic sheets, electrodes 34 may be secured directly to arms 20 and 22 at the four apertures. If, however, support arms 20 and 22 are formed from an electrically conductive material, such as, for example, spring steel, electrodes 34 must be isolated from support arms 20 and 22. This may be accomplished by fitting plastic insulation inserts into apertures 22, 24, 26, 28 and 30, then securing electrodes 34 in these plastic inserts.

In the preferred embodiment, electrodes 34 are thin and quite flexible. In order to operate effectively they must be rigidly maintained between support arms 20 and 22. That is, they must be held under tension in order to keep them straight. In order to maintain this tension coupling member 44 is secured to and extends between support arms 20 and 22. Member 44 is positioned between surface 18 of baseplate 12 and electrodes 34 and is curved in order to give it rigidity. In addition to providing the noted tension it acts also to couple support arms 20 and 22 together and to insure that both support arms 20 and 22, as well as the corona electrodes 34, move in synchronism.

An insulated conductor 36 is connected at one end to the ends of electrodes 34 at apertures 24 and 26 respectively. The other end of insulated conductor 36 is secured to electrical connection terminal 40. A fractional horsepower motor 46 is shown secured to side 18 of baseplate 12 with the rotating shaft thereof extending substantially perpendicular to the plane of baseplate 12. Motor 46 has a rotational speed of approximately 1800 rpm. An eccentric 50 is secured to the end of rotating shaft 48 and a connection or coupling arm 52 connects eccentric 50 to a pivot pin 51 which is secured to pivot arm 53. Pivot arm 53 is secured to supporting arm 22 at location 54. The rotation of rotating shaft 48 and eccentric 50 will cause connection or coupling arm 52 to move longitudinally while pivoting somewhat at pivot pin 51 so that connection arm 52 reciprocates. Connection arm 52 will reciprocate at 1800 reciprocations per minute the same reciprocation rate as the speed of motor 46. The movement or reciprocation of connection arm 52 puts tension on pivot arm 53 which causes supporting arm 22 to flex or bend following the movement of connection arm 52. The movement of arm 22 is transferred, via the member 44 to support arm 20 so that the entire structure consisting of support arms 20 and 22, member 44 and electrodes 34 reciprocates in a longitudinal direction with the rotation of shaft 48 in motor 46. Conductors for providing an electrical connection to motor 46 are shown connected to electrical connection terminals 56 and 58.

Connection terminal 58 for one side of the motor winding is shown schematically as being connected to ground potential. Electrical connection terminal 40 is coupled via conductor 60 to the output of a corona power supply 62. Corona power supply 62 may be any one of the type well known in the art which will supply a voltage sufficient to cause electrodes 34 to develop a corona. The input control to corona power supply 62 is coupled via conductor 64 to one output of control circuit 66. A second output of control circuit 66 is coupled via conductor 68 to terminal 56, which as noted previously is connected to motor 46. A switch 72 has one terminal thereof coupled to the input of control circuit 66 and the other terminal connected to ground potential. The third output of control circuit 66 is coupled via conductor 70 to an electrophotographic member drive transport 74 shown in block diagram form in FIG. 2 which operates to move electrophotographic member 76.

Figure 2:
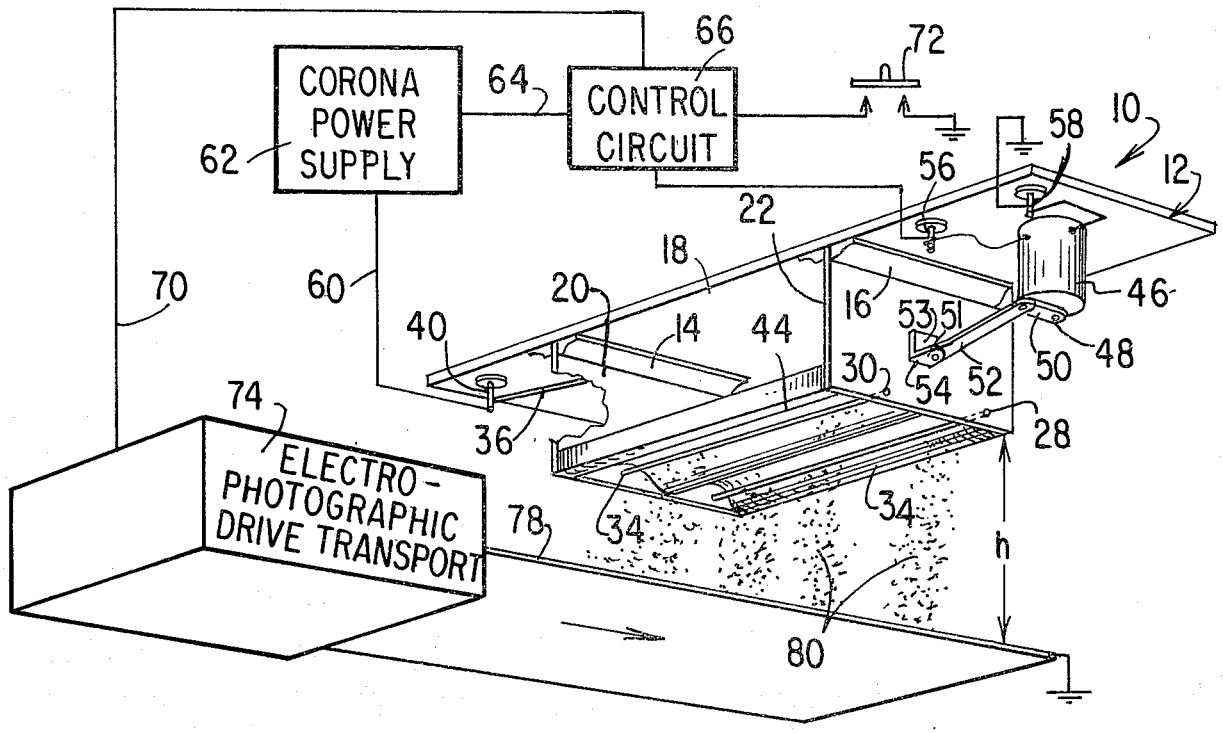
FIG. 2 is another view of the corona discharge apparatus of this invention and a partial block diagram of the associated electronic equipment.

Referring to FIG. 2 corona producing device 10 is shown positioned above electrophotographic member 76 whose upper or imaging surface 78 is to be charged. Corona producing device 10 and electrodes 34 are positioned with the longitudinal axis or direction of electrodes 34 transverse to the direction of movement of member 76 and at a predetermined distance or height above surface 78 of electrophotographic member 76.

In operation, push button switch 72 is momentarily depressed providing a ground connection to control circuit 66. Control circuit 66 upon actuation will develop three control signals. The first control signal is coupled via conductor 68 and connection terminal 56 to motor 46 causing the motor to begin rotating and reciprocating support arms 20 and 22, member 44 and electrodes 34 at the first reciprocation rate or speed noted previously. The second control signal is developed by control circuit 66 at the same time as the first control signal and is coupled to corona power supply 62 via conductor 64 energizing supply 62 to develop the necessary corona voltage. The corona voltage is coupled to electrodes 34 via conductor 60 so that the desired corona is developed in the area surrounding electrode 34.

It is believed that the electrodes 34 exhibit nonuniformity in the form of nodes at random points on their surfaces which create higher energy corona emissions. The reciprocation of the electrodes 34 causes the corona emission from each node, which moves identically with the electrodes 34, to charge a greater area of the electrophotographic member. The reciprocation amplitude is made large enough such that the areas charged by each seperate node will overlap, resulting in a uniform charge on the electrophotographic member. The corona voltage developed by supply 62 will continue for a period of time determined by the length of the control signal from control circuit 66 which is a period sufficient to totally charge the surface 78 of the portion of the electrophotographic member 76 to be exposed.

The third control signal developed by control circuit 66 is developed simultaneously with the first and second control signals and is coupled by conductor 70 to electrophotographic drive transport 74. Electrophotographic drive transport 74 causes the electrophotographic member 76 to move past the longitudinally reciprocating electrodes 34 at a second rate of speed. The speed of movement of electrophotographic member 76 produced by drive transport 74 and the reciprocation speed of electrodes 34 are selected such that the corona, shown via the dots 80 in FIG. 2 will be substantially uniformly dispersed around and below electrodes 34 thus uniformly charging the entire surface 78 of member 76. When the portion of member 76 to be exposed has been charged all three control signals will terminate.

All of the apparatus shown in FIG. 2 is secured in a closed housing (not shown), particularly member 76 which must be maintained in a dark environment except when exposed to the lighted image to be reproduced. In this embodiment, surface 78 of member 76 is exposed to the lighted image to be reproduced immediately after it has been charged and passed beyond the charging area of corona producing device 10. The exposure preferably occurs as member 76 moves beyond corona producing device 10 with sections of the entire image being continuously, sequentially exposed to corresponding sections of the member 76 during its movement. This can be performed by a shutter like device whose operation must also be synchronized with the operation of control circuit 66. This technique eliminates the possibility of producing a nonuniform electrostatic image as a result of variations in charge levels on the surface 78 of member 76 which can result from delaying exposure until the entire portion of member 76 to be exposed is charged.

It is to be understood that although the preferred embodiment is shown with electrophotographic member 76 being moved relative to corona producing device 10 while electrodes 34 reciprocate, such an arrangement is not the only one feasible. In an alternate embodiment electrophotographic member 76 may be fixed and corona producing device 10 may be mounted to a movable track. Electrophotographic drive transport 74 would be omitted in such an arrangement and a second drive would be provided for moving corona producing device 10 along the track to which it is mounted in a direction transverse to the direction of reciprocation of electrodes 34 at a second rate of speed as noted above. In this arrangement as well as the previously described arrangement the primary requirement is that electrodes 34 and member 76 are moved relative to one another while electrodes 34 are reciprocated in a longitudinal direction.

What it is desired to secure by Letters Patent of the United States is:

1. A corona discharge apparatus for charging an electrophotographic imaging surface including in combination:

corona producing means including at least one elongate longitudinally disposed corona electrode having a first and second end, support means including a portion for mounting said corona electrode at least at said first and second ends, said support means corona mounting portion adapted to reciprocate substantially in the longitudinal direction, and drive means coupled to said support means for reciprocating said support means in said longitudinal direction.

2. The corona discharge apparatus of claim 1 further including second drive means coupled to one of said support means and said imaging surface for moving one relative to the other during said reciprocation.

3. The corona discharge apparatus of claim 2 wherein said first drive means move said support means at a first reciprocation speed and said second drive means move one of said support means and said imaging surface at a second speed.

4. The corona discharge apparatus of claim 2 further including, a corona power supply coupled to said corona producing means for coupling a corona voltage thereto, and control circuit means coupled to said corona power supply and said first and second drive means and operative upon initiation to energize said corona power supply for developing said voltage, to energize said drive means for reciprocating said corona producing means, and to energize said second drive means for moving one of said imaging surface and support means.

5. The corona discharge apparatus of claim 4 wherein said control circuit means include, circuit means for synchronizing operation of said corona power supply and said first and second drive means.

6. The corona discharge apparatus of claim 1 wherein said support means include, a baseplate, said portion for mounting said corona including at least two support arms each secured at a first end thereof to said baseplate and spaced apart a predetermined distance, said support arms each extending substantially perpendicular to said baseplate for a predetermined length to a second end, said corona producing means extending longitudinally between said support arms adjacent said second ends with said corona producing means first end secured to the first of said support arms and said corona producing means second end secured to the second of said support arms, said support arms adapted to reciprocate in said longitudinal direction.

7. The corona discharge apparatus of claim 6 wherein said support arms are flexible and bend in said longitudinal direction for reciprocating said corona producing means.

8. The corona discharge apparatus of claim 7 wherein said support arms are formed from thin sheets of flexible material.

9. The corona discharge apparatus of claim 6 further including a coupling member secured to said support arms and extending longitudinally therebetween for synchronizing the reciprocating motion of said support arms and said electrode.

10. The corona discharge apparatus of claim 1 wherein said drive means include, a motor having a rotating shaft, eccentric means secured to said shaft and rotating therewith, and coupling means coupling said eccentric means to said support means, said motor rotation reciprocating said coupling means and said support means.

11. A corona apparatus for developing a corona to charge an electrophotographic member including in combination, a baseplate, at least two support arms each secured at a first end thereof to said baseplate and spaced apart a predetermined distance, said support arms each extending substantially perpendicular to said baseplate for a predetermined length to a second end, at least one corona electrode extending substantially parallel to said baseplate between said support arms adjacent said second end thereof, said support arms adapted to reciprocate substantially in the direction of extension of said electrode.

12. The corona apparatus of claim 11 wherein said support arms are flexible and bend in the direction of extension of said electrode.

13. The corona apparatus of claim 12 wherein said support arms are formed from thin sheets of flexible material.

14. The corona apparatus of claim 11 further including a coupling member secured to said support arms and extending therebetween for synchronizing the reciprocating motion of said support arms and said electrode.

* * * * *